US009476269B2

(12) United States Patent
Dyck

(10) Patent No.: US 9,476,269 B2
(45) Date of Patent: Oct. 25, 2016

(54) APPARATUS AND METHOD FOR PULLING AND LAYING POLY PIPE

(71) Applicant: Peter E Dyck, Seminole, TX (US)

(72) Inventor: Peter E Dyck, Seminole, TX (US)

( * ) Notice: Subject to any disclaimer, the term of this patent is extended or adjusted under 35 U.S.C. 154(b) by 0 days.

(21) Appl. No.: 14/253,532

(22) Filed: Apr. 15, 2014

(65) Prior Publication Data

US 2015/0292282 A1 Oct. 15, 2015

(51) Int. Cl.

| | |
|---|---|
| ***E21B 19/22*** | (2006.01) |
| ***E21B 19/00*** | (2006.01) |
| ***B65H 75/42*** | (2006.01) |
| ***B65H 75/44*** | (2006.01) |

(52) U.S. Cl.

CPC ..... *E21B 19/22* (2013.01); *B65H 75/425* (2013.01); *B65H 75/4442* (2013.01); *E21B 19/008* (2013.01); *B65H 2701/33* (2013.01)

(58) Field of Classification Search

CPC combination set(s) only.
See application file for complete search history.

(56) References Cited

U.S. PATENT DOCUMENTS

| | | | | |
|---|---|---|---|---|
| 3,100,530 | A * | 8/1963 | Coleman | E21B 33/02 166/290 |
| 3,116,781 | A | 1/1964 | Rugeley | |
| 3,991,978 | A | 11/1976 | Jones | |
| 4,148,445 | A | 4/1979 | Reynolds | |
| 4,296,916 | A | 10/1981 | Jewett | |
| 4,454,999 | A * | 6/1984 | Woodruff | B65H 49/34 242/388.7 |
| 4,523,645 | A | 6/1985 | Moore | |
| 4,673,035 | A * | 6/1987 | Gipson | E21B 19/22 166/77.1 |
| 4,986,351 | A | 1/1991 | Bowers | |
| 5,078,546 | A | 1/1992 | Fisk | |
| 5,180,014 | A * | 1/1993 | Cox | E21B 23/14 166/384 |
| 5,848,641 | A | 12/1998 | Epp | |
| 5,996,971 | A | 12/1999 | Crouse | |
| 6,276,454 | B1 | 8/2001 | Fontana | |
| 6,419,424 | B1 | 7/2002 | Null | |
| 6,502,641 | B1 | 1/2003 | Carriere | |
| 6,516,891 | B1 | 2/2003 | Dallas | |
| 7,028,781 | B2 | 4/2006 | Hill | |
| 7,810,574 | B2 * | 10/2010 | Stukey | E21B 19/22 166/384 |
| 7,845,419 | B2 | 12/2010 | Naumann | |
| 7,874,510 | B2 | 1/2011 | Martin | |
| 8,056,620 | B2 | 11/2011 | Tubel | |
| 2012/0061504 | A1 | 3/2012 | Powell | |
| 2013/0015650 | A1 | 1/2013 | Lapstun | |
| 2013/0115005 | A1 | 5/2013 | Ephan, Jr. | |

* cited by examiner

*Primary Examiner* — David Andrews
*Assistant Examiner* — Ronald Runyan
(74) *Attorney, Agent, or Firm* — Matthew Burr

(57) ABSTRACT

An apparatus for pulling irrigation poly provides a transportable poly reel rig with a reel spool pivotally mounted to the reel rig. A manual primary brake is in hydraulic braking communication with the reel spool to manually control free spooling. A secondary brake, hydraulically integrated in a planetary gear drive connected to the spool, is activated automatically when hydraulic pressure falls below a safe level. A top alignment reel positioned under the reel spool, and a bottom alignment reel positioned under the top alignment reel, facilitate alignment of the reel spool with a well bore. A wire roller operating in concert with the reel spool facilitates attachment to and take-up of wire attached to the poly. Two or more hydraulic stabilizers stabilize the rig, as does a boom assembly mounted to the reel rig. Methods of using the apparatus utilize a smaller crew of operators than with prior apparatus.

9 Claims, 7 Drawing Sheets

APPARATUS AND METHOD FOR PULLING AND LAYING POLY PIPE

TECHNICAL FIELD

This disclosure relates generally to rigs for pulling flexible water pipe from the ground and more particularly to a rig having a plurality of alignment reels and a secondary brake to inhibit free spooling.

BACKGROUND

Modern irrigation systems employ subterranean pumps connected by lengths of flexible tubing in irrigation trenches and to a water supply. Although various types of flexible tubing are known, the most commonly used tubing today is a polyolefin, such as polyethylene, usually referred to by those in the industry as "poly." The underground pump is typically electrically driven, so a power wire, cord or cable is typically attached to the flexible tubing, as by taping the cable to the tubing.

In systems which have underground pumps for pumping water through long flexible plastic tubing of the type which has been described (hereafter "well flexible tubing"), tubing installation and removal has tended to be a difficult operation since these procedures are labor intensive and time consuming. It is not unusual for a crew of five or six people to be deployed to pull poly from the ground to replace or maintain a pump.

There are various reasons why it is necessary to pull the well tubing from the irrigation trenches. On occasion, it is necessary to access the underground pump, either for servicing or replacement, or because the pump must be relocated at a different elevation in the ground. In the past, when removal of the submersible pump was necessary, often the pump had to be physically removed from the ground as by raising the pump by the flexible water pipe or tubing. Since irrigation trenches can be hundreds of feet long, this results in hundreds of feet of length of the flexible water pipe and associated electrical wiring which must be accommodated. Removal of underground pumps, as well as the removal of other types of irrigation and servicing devices, such as coiled tubing, has previously been accomplished by a variety of methods. In small plots, where the weight of the pump and the length of the flexible water pipe tubing is relatively small, physical manual hoisting of the pump and pipe has sometimes been used.

Various mechanical devices have been developed over the years for removing other types of well devices. For example, U.S. Pat. No. 6,502,641 to Carriere, et al. shows a coiled tubing rig which includes a frame, a tiltable mast and an injector reel. The mast can be tilted to a position that aligns the coiled tubing with the BOP. However, this device is not used as a device for pulling a submersible pump from a well.

U.S. Pat. No. 5,848,641 shows a well pump puller. Modem water wells are drilled into the ground with the well bore either being uncased, or being protected by a casing which is sunk into the well. Typically, a submersible pump is then run down the well bore on flexible tubing and submerged Although this reference shows a cylindrical drum and a companion guide, it does not appear that the cylindrical drum pivots from the horizontal to a vertical position.

U.S. Pat. No. 3,116,781 shows a well workover apparatus 20 including a cylindrical drum 12 and a yoke mechanism 18.

U.S. Pat. No. 3,991,978 shows a submersible pump boom which can be used for pulling or replacing a submersible pump.

U.S. Pat. No. 4,986,351 shows a device used for pump removal which includes a collar which is secured to the upper end of a well casing.

U.S. Pat. No. 4,523,645 shows an apparatus for removing reeved material from a wellbore such as a cable, electrical line or fluid conductor.

U.S. Pat. No. 4,296,916 shows another type of device for pulling submersible pumps from a well bore.

U.S. Pat. No. 4,673,035 is another apparatus which deals with a coil tubing operation. This reference does appear to show a cylindrical drum (25 in FIG. 1) which may be elevated to allow the operation of the apparatus with elevated well heads.

U.S. Pat. No. 5,996,971 shows another type of well pipe hoist which is secured to the well casing at the top of the well.

While the above references, and others, show a variety of devices which have been used in the past for raising and lowering flexible tubing from a well bore, a need continues to exist for an improved submersible pump puller which is simple in design, economical to manufacture and requires a small crew of human operators than prior designs and methods.

A need also exists for such a device which can be portably mounted for transport from one well location to another.

A need also exists for such an apparatus which evenly centers the vertical axis of the flexible tubing being fed into the well bore over the central vertical axis of the bore hole, so that contact between the flexible tubing and the sides or upper lip regions of the well casing is largely avoided.

SUMMARY

The apparatus of the invention can be used in an improved method for lowering and pulling a submersible pump from a well bore where the pump is supported on a length of flexible tubing initially wound up on a take up reel. In the first step of the method, portable base frame, on which a rig is mounted, is transportable from one well location to another. The portable base frame is supported in a horizontal plane with respect to a surrounding support surface such as the ground, whereby the cantilever arm is capable of pivoting movement in a plane generally parallel to the plane of the base frame.

A pair of oppositely arranged support arms are mounted on the pivot frame, each of the support arms being pivotally mounted at an inner extent on the base frame and a cantilever arm and having an opposite outer extent. Each of the support arms is provided with a telescoping extension portion, which are telescopically mounted with respect to the outer extent of each of the support arms for extension and retraction with respect to the support arms.

A cylindrical take up reel is provided having opposing sides separated by a central region for accumulating the flexible tubing, each of the opposing sides of the cylindrical take up reel being supported on the portable base frame by connection to the cantilever arm. A primary pivot mechanism has a first end attached to the frame and has a second end pivotally attached to the cantilever arm whereby actuation of the primary pivot mechanism serves to pivot the support arm and, in turn, the cylindrical take up reel between a collapsed horizontal position on the base frame and an extended, upright position.

Alignment reels are mounted to the pivot mechanism and alignment reel controllers are attached to the frame and hydraulically connected to the alignment reels to adjust the position of the alignment reels both vertically, and horizontally, whereby the position of the alignment reels can be accurately centered with respect to a vertical axis of a well bore, even where the frame is not positioned to center the take up reel over the well bore, to be accessed for raising and lowering the submersible pump into the well bore.

In the first step of using the apparatus, the base frame is typically transported to a well site adjacent a well bore having a vertical well axis. The primary pivot mechanism is then actuated to raise the cantilever arm and, in turn, the take up reel from a collapsed position to a work position which is vertically oriented with respect to the vertical axis of the well bore with the submersible pump being centered up as much as possible with respect to the well bore vertical axis.

The position of the alignment reels can be further adjusted by actuating the alignment reel controllers to cause the alignment reels to move in a desired path with respect to the base frame, thereby further centering the submersible pump and take up reel over the vertical axis of the well bore.

The take up reel is then actuated to dispense a required length of flexible tubing so that the submersible pump is gradually lowered into the well bore. When the desired depth is reached, the upper end of the flexible tubing is secured at the well head.

A primary brake is engaged automatically to limit free spooling of spool 81 when an operational parameter, such as hydraulic pressure, is exceeded. For example, if hydraulic pressure is reduced due a ruptured hose, the primary brake engages automatically. A secondary brake having a planetary gear system can be manually engaged with controllers to up or down shift the planetary gears for controlled spooling.

For extra safety, the boom apparatus can be deployed to stabilize the rig and the frame during operations.

In addition to providing mechanisms for improved alignment and safety, the present invention is sufficiently safe and automated that poly pipe can be pulled by the rig with no more than 2 human operators, providing a much more economical solution to pump pulling than is presently available.

BRIEF DESCRIPTION OF THE DRAWINGS

For a more complete understanding of the present disclosure, and the advantages thereof, reference is now made to the following descriptions taken in conjunction with the accompanying drawings, in which.

DETAILED DESCRIPTION

The embodiments herein and the various features and advantageous details thereof are explained more fully with reference to the non-limiting embodiments that are illustrated in the accompanying drawings and detailed in the following description. Descriptions of well-known components and processes and manufacturing techniques are omitted so as to not unnecessarily obscure the embodiments herein. The examples used herein are intended merely to facilitate an understanding of ways in which the invention herein may be practiced and to further enable those of skill in the art to practice the embodiments herein. Accordingly, the examples should not be construed as limiting the scope of the claimed invention.

Figure 1:
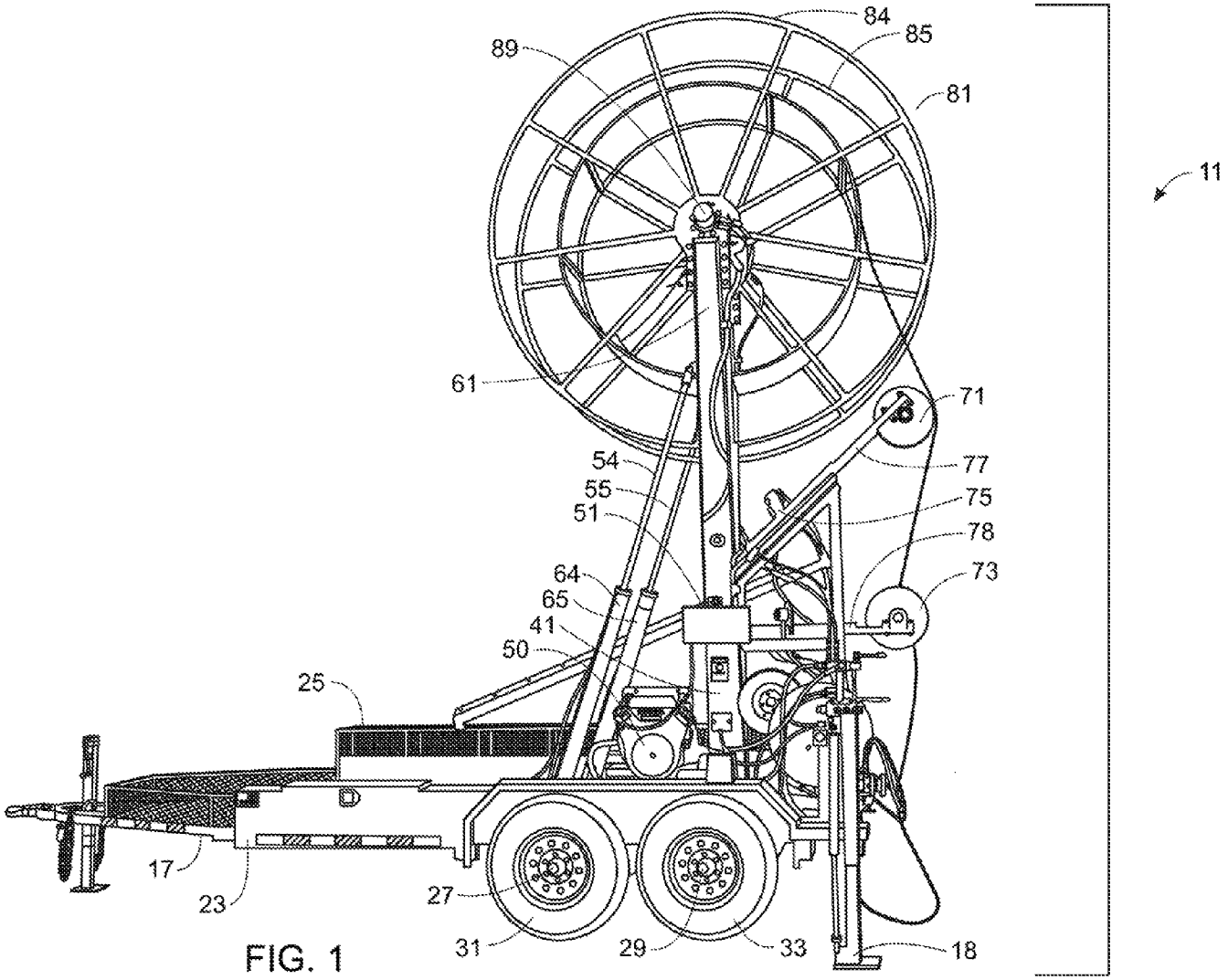
FIG. 1 is an isometric proximate side view of a poly pulling rig of the present invention.

Turning now to FIG. 1, there is shown an apparatus 11 for raising and lowering a length of flexible poly pipe in an irrigation system, where the pump is run on a length of flexible tubing (not shown). In the example illustrated in FIG. 1, the flexible tubing is poly ethylene tubing, also referred to colloquially as "poly." As will be appreciated from the drawings, the apparatus of the invention includes a portable base 17 of a generally polygonal configuration, in this case a rectangular frame. The frame is made up of front and rear elongate members 19, 21, and elongate side members 23, 25. The frame 17 can be made of any convenient sturdy material, e. g., channel iron or the like. As will be appreciated from FIG. 1, the frame 17 is supported on a pair of axles 27, 29 and associated wheels 31, 33, so that the frame can be transported from one well location to another. A trailer hitch is provided to hook up apparatus 11 to a pickup or other suitable transport vehicle. The frame could also be transferred in other ways as, for example, by being skid mounted, or truck or trailer mounted.

As also will be appreciated from FIG. 1, the wheels 31, 33 and axles 27, 29 support frame 17 in a substantially horizontal plane with respect to the ground. Hydraulic struts or stabilizers 18 are adjustable between a retracted position and the extended position once the base frame has been temporarily positioned.

Cantilever arms 61, shown in FIG. 1 in their vertical orientation, are pivotally mounted to support member 41, on frame 17 at pivot point 51 so that they can be raised for pulling operations, and lowered to a substantially horizontal orientation for transport. Each pivot mechanism, in this case paired hydraulic cylinders 64, 65, has a cylinder body mounted to frame 17 forward of support members 41, 43, and an telescoping extension shafts 54, 55.

The hydraulic cylinders 64, 65 as well as the other hydraulic cylinders used in the apparatus, are of conventional design and are commercially available from a number of convenient sources. They are hydraulically powered by a hydraulic motor as will be well understood by those skilled in the relevant arts.

The cylindrical take up reel (81 in FIG. 1) has opposing sides 84, 85, and a central region extending between the opposing sides for accumulating the continuous roll of flexible tubing on a spool. Each of the opposing sides 84, 85, of the cylindrical take up reel is supported on the portable base frame 17 by connection to the extension portions 54, 55 of each of the respective support arms 64, 65.

Figure 5:
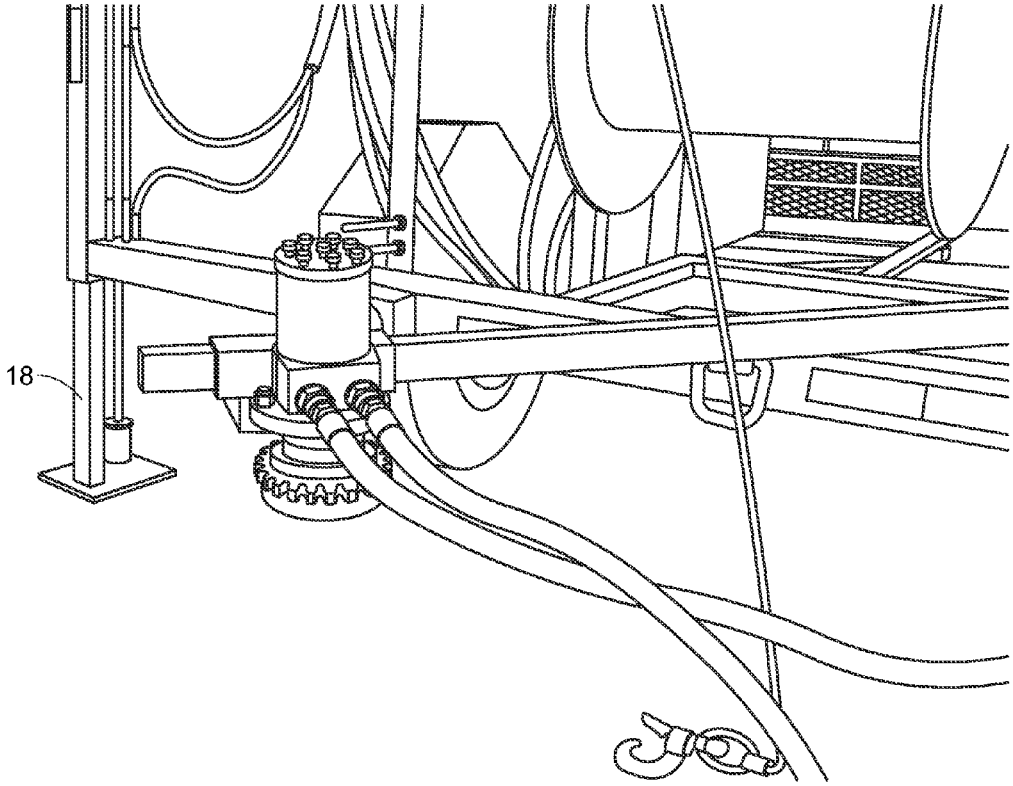
FIG. 5 is an isometric of a detail of a rig of the present invention depicting an hydraulic telescoping stabilizer.

With reference now to FIGS. 1 and 5, it will be seen that the cantilever arms 61, 63 and the telescoping extensions 64, 65 are each pivoted between a vertical or horizontal position by a primary pivot mechanism as described above for cantilever arms 61, 63. Actuation of the primary pivot mechanism serves to pivot the cantilever arms and telescoping extensions 54, 55 and, in turn, the cylindrical take up reel between the horizontal position, and the vertical, upright position.

Alignment reels 71, 73 are attached to respective support members 77, 78, that position the alignment reels under take up reel 81 to guide the poly hose onto take up reel 81. Situated on support member 77 is primary brake 75, which provides an automatic fluid-driven shut off mechanism, wherein a shut-off valve closes when fluid in the brake reaches a pre-determined pressure. The advantage of the alignment reels 71, 73, both top and bottom, is to keep the rig 11 apparatus centered to the casing at the bottom of the pump well (the casing can be steel pipe or pvc pipe). It is advantageous to align the present apparatus over the pump well so that the well casing is not engaged at the wrong angle so as to damage to the casing. Additionally, if the rig is not entirely positioned to the well properly, such as may be the case where the terrain does not permit positioning the rig to the well, than the alignment reel controllers (see, FIG. 3) that control the alignment reels can be operated to assist getting the hose and pump angled and aligned properly.

When laying poly pipe to an electric pump, it is necessary to provide electricity to the pump. To this end, rig operators attach wire to the poly pipe periodically along its length as the poly unspools. Mounted on frame 17 between cantilever arms 64, 65 and support members 41, 43 is wire roller 50 which unspools wire for attachment to the poly pipe during pipe unspooling, and which takes up the wire during poly pipe pulling.

Figure 2:
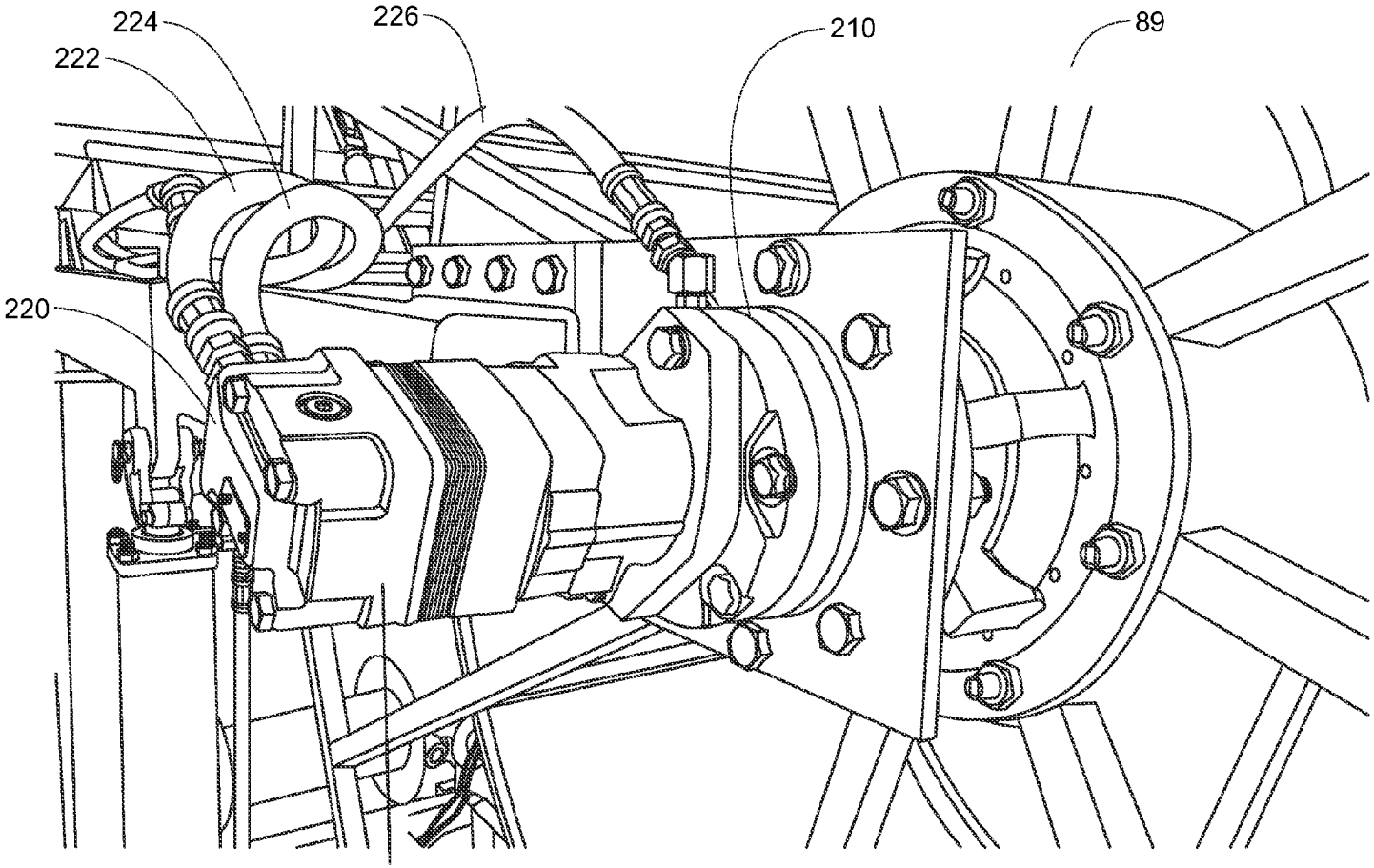
FIG. 2 is an isometric perspective exterior view of a secondary brake planetary gear box of a rig of the present invention.

As can be seen in FIG. 1, support arm 61 mounts to a commercially available gear reduction unit at main hub 89. FIG. 2 provides a detailed exterior view of a secondary brake mounted on main hub 89. While a variety of commercially available gear reduction units might be utilized, the particular unit illustrated utilizes a planetary gear system 210 in which a hydraulic motor 220 drives the center gear of the unit on either side of the take up reel. Motor 220 is controlled, in part, via hydraulic fluid conduits 222, 224, 226. A ring gear is turned by a set of planetary gears to provide a desired gear reduction. The ring gear is, in turn, attached to the proximate main hub 89 upon which a cylindrical drum is mounted. There is an identical arrangement on the distal, opposite, side of the cylindrical drum and hub.

Figure 3:
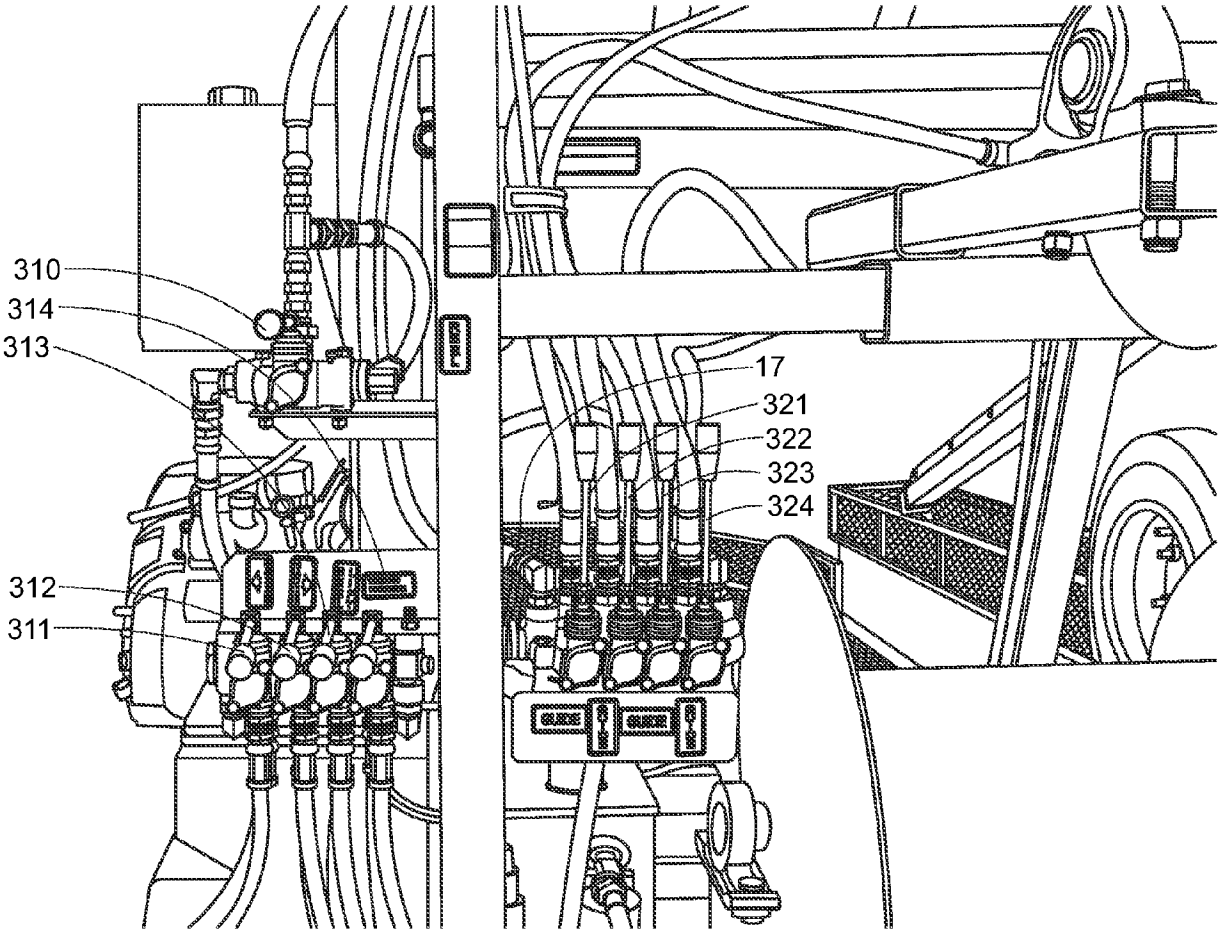
FIG. 3 is an isometric view of hydraulic controllers for a rig of the present invention.

Take up reel 81 and wire roller 50 are hydraulically controlled by controllers mounted to base 17, as shown in FIG. 3. Lever 310 labeled "REEL" controls the spool which one of the human operators controls. Below spool controller 310 and reading from left to right are the labels:

← Stabilizer (controls left stabilizer) 311

→ Stabilizer (controls right stabilizer) 312

REEL Lift (lifts the entire reel)313

Threader/Wire Roller (controls the wire roller and threader) 314

Further to the right, hydraulic controllers 321, 322, 323, 324, identified by labels displaying "GUIDE," in vertical and horizontal orientations, control positioning of the alignment reels 71, 73 horizontally and vertically, as shown. Although the embodiments of the present invention are described herein using hydraulic controllers and brakes, the description is intended as merely illustrative of a particular embodiment and not to limit the scope of the invention. It will be understood by those skilled in the art that other suitable types of controllers, such as electrical or pneumatic, for example, may be implemented as matter of engineering design choice.

Figure 4:
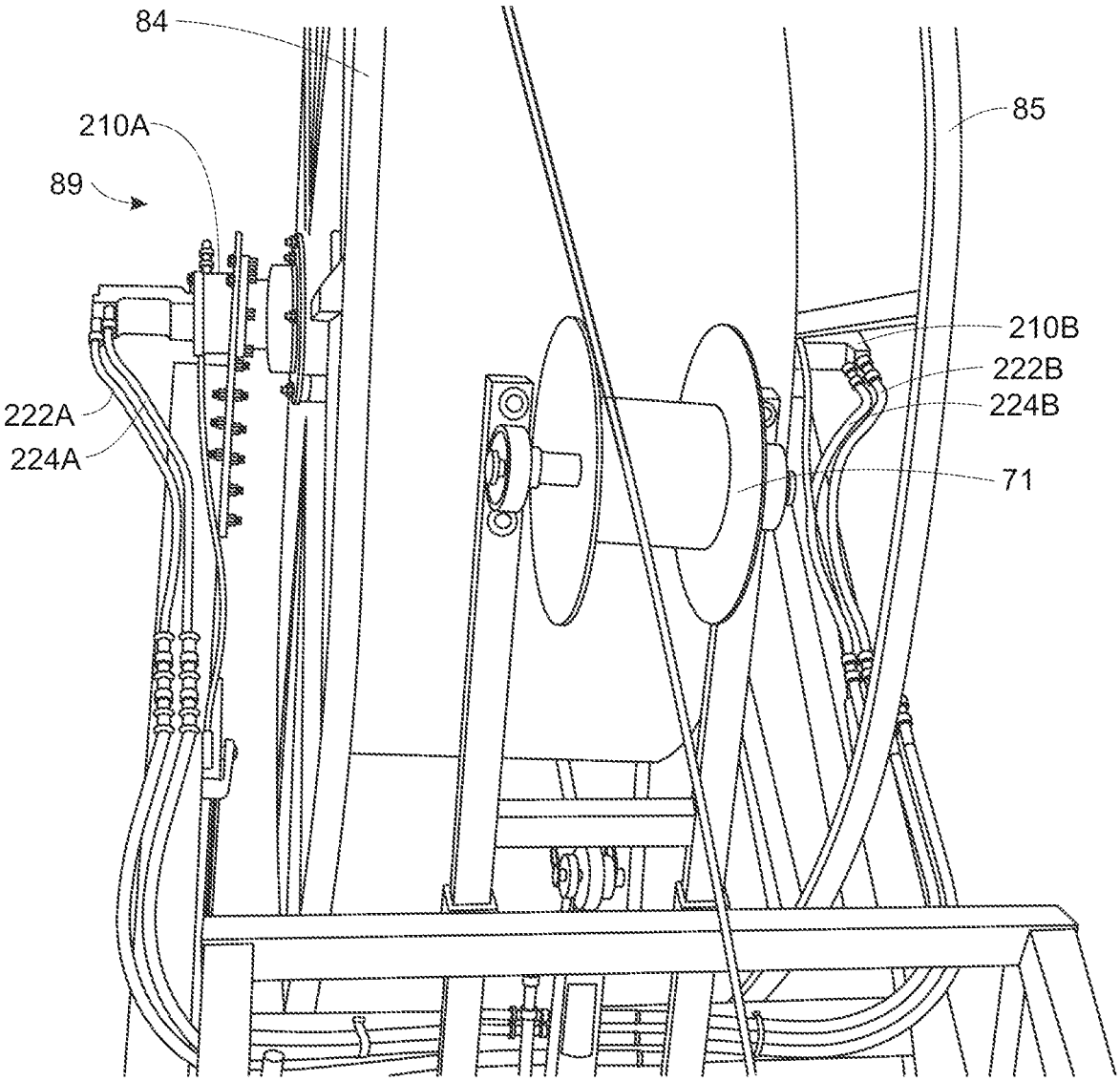
FIG. 4 is an isometric front view an alignment reel of a rig of the present invention.

Alignment reel 71 is shown from the rear of rig 11 in FIG. 4. From this perspective, proximate secondary brake 210 and its hydraulic control conduits 222A, 224A, as described in FIG. 2, are on the left by reel 84. Corresponding distal secondary brake 210B and its hydraulic control conduits 222B, 224B are visible by reel 85.

FIG. 5 is a perspective rear view detail of rig 11. Rear proximate telescoping stabilizer 18 assists stabilizing rig 11 by extending or retracting a telescoping member of the stabilizer as dictated by the topology of the underlying surface, such as a roadway or irrigation field. A corresponding stabilizer (not shown) is preferably provided on the distal side of rig 11, as well.

Figure 6:
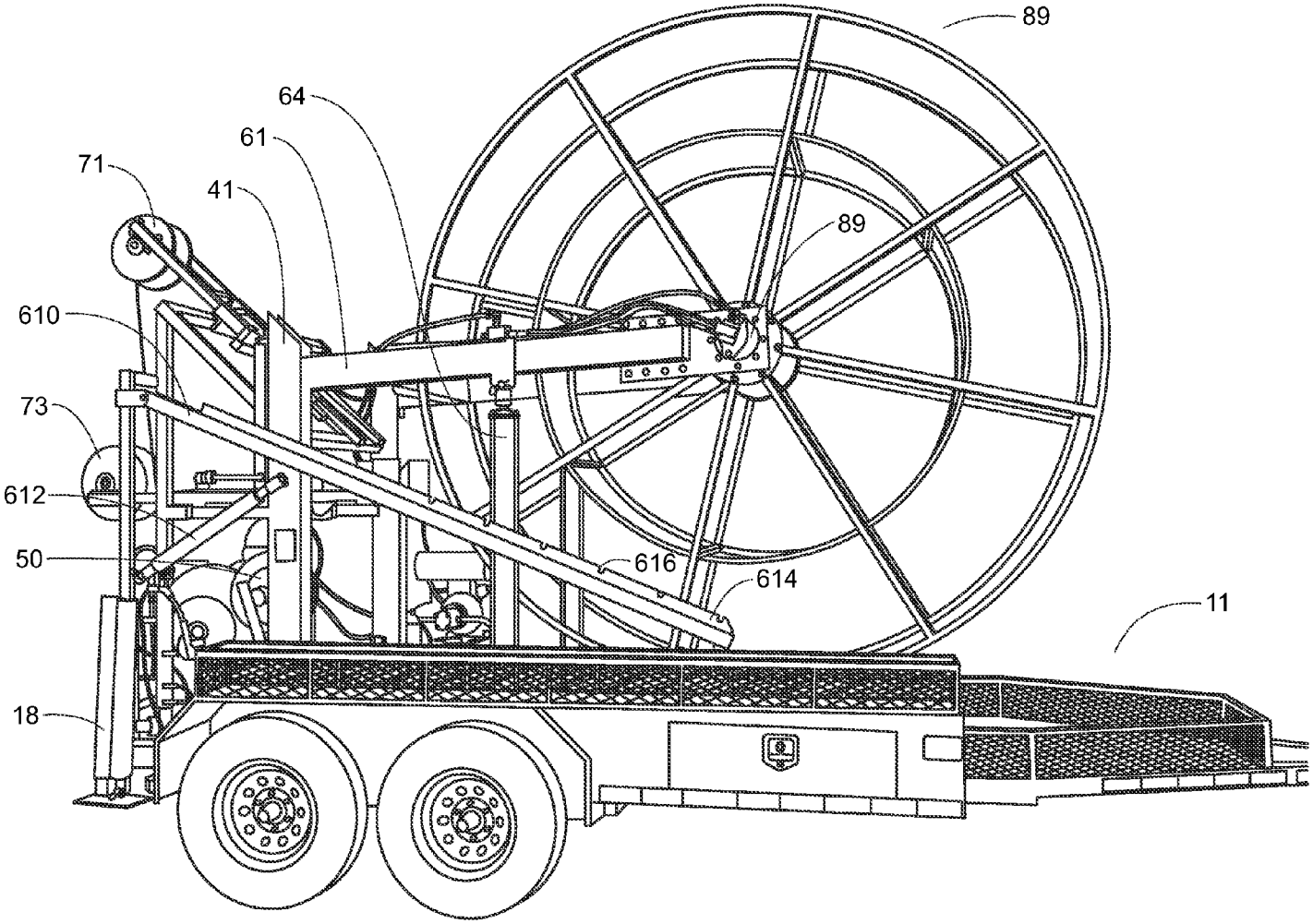
FIG. 6 is an isometric distal view of the rig of FIG. 1, in a stowed position.
Figure 7:
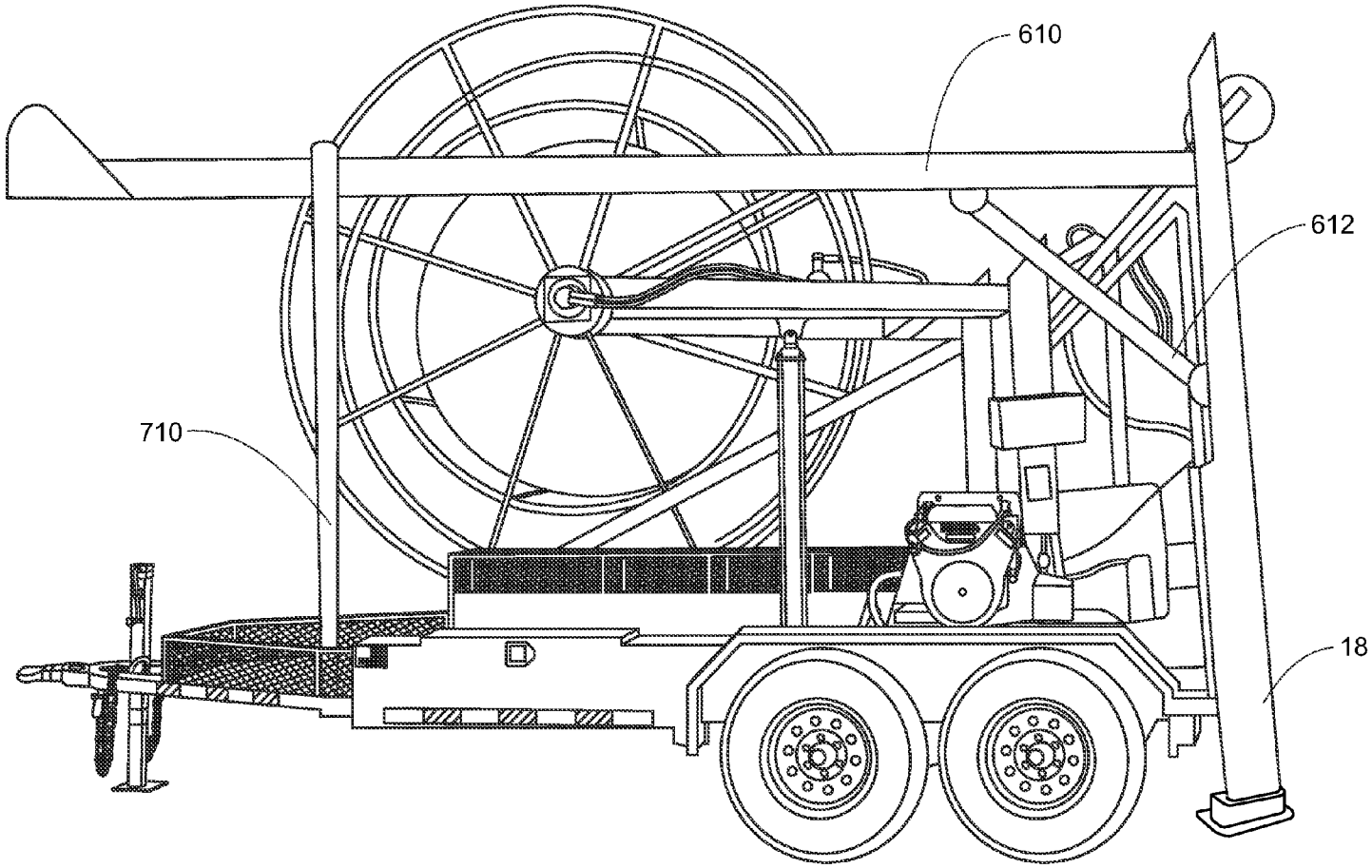
FIG. 7 is an isometric proximate view of the rig of FIG. 6, depicting a boom assembly.

FIG. 6 is an isometric distal side view of rig 11 and FIG. 7 is an isometric proximate side view of rig 11. An additional safety feature of rig 11 is boom member 610, shown partially disassembled in FIG. 6 so that the front end of boom 610 rests on the rig 11 trailed bed. Hydraulically telescoping boom front support member 612 is pivotally connected to boom 610 and to stabilizer 18 to assist raising boom 610 to its operational horizontal position (see, FIG. 7) and lowering boom 610 when rig 11 is not in use. Plate 614 provides notches 616 which engage rear boom support member 710 (see, FIG. 7). A boom assembly having boom 610, front boom support member 612, and rear boom support member 710 advantageously helps stabilize rig 11 during spooling or pulling operations, particular from torque, twisting, forces that might be encountered during operation, when, for example, resistance in pulling a poly pipe is encountered by rig 11 on uneven terrain.

The general operation of the apparatus of the invention will now be briefly described. The apparatus of the invention can be used in an improved method for lowering and pulling a submersible pump from a well bore where the pump is supported on a length of flexible tubing initially wound up on a take up reel. In the first step of the method, portable base frame 17 on which take up reel 81 is transportable from one well location to another. The portable base frame 17 is supported in a horizontal plane with respect to a surrounding support surface such as the ground, whereby the cantilever arm 61 is capable of pivoting movement in a plane generally parallel to the plane of the base frame.

A pair of oppositely arranged support arms 64, 65, are mounted on the pivot frame 17, each of the support arms being pivotally mounted at an inner extent on the base frame 17 and cantilever arm 61 and having an opposite outer extent. Each of the support arms 64, 65, is provided with a telescoping extension portion 54, 55, respectively, which are telescopically mounted with respect to the outer extent of each of the support arms for extension and retraction with respect to the support arms.

A cylindrical take up reel 81 is provided having opposing sides 84, 85 separated by a central region for accumulating the flexible tubing, each of the opposing sides of the cylindrical take up reel being supported on the portable base frame by connection to the cantilever arm. A primary pivot mechanism 41 has a first end attached to the frame 71 and has a second end pivotally attached to the cantilever arm whereby actuation of the primary pivot mechanism serves to pivot the support arm and, in turn, the cylindrical take up reel between a collapsed horizontal position on the base frame 17 and an extended, upright position.

Alignment reels 71, 73 are mounted to pivot mechanism 41 and alignment reel controllers 321, 322, 323, 324 are attached to frame 17 and hydraulically connected to the alignment reels to adjust the position of the alignment reels both vertically, horizontally, and telescopically, whereby the position of the alignment reels can be accurately centered with respect to a vertical axis of a well bore, even where frame 17 is not positioned to center take up reel 81, to be accessed for raising and lowering the submersible pump into the well bore.

In the first step of using the apparatus, the base frame 17 is typically transported to a well site adjacent a well bore having a vertical well axis. The primary pivot mechanism is then actuated to raise the cantilever arm and, in turn, the take up reel from a collapsed position to a work position which is vertically oriented with respect to the vertical axis of the well bore with the submersible pump being centered up as much as possible with respect to the well bore vertical axis.

The position of the alignment reels can be further adjusted by actuating the alignment reel controllers to cause the alignment reels to move in a desired path with respect to the base frame, thereby further centering the submersible pump and take up reel over the vertical axis of the well bore.

The take up reel 81 is then actuated to dispense a required length of flexible tubing so that the submersible pump is gradually lowered into the well bore. When the desired depth is reached, the upper end of the flexible tubing is secured at the well head.

Primary brake 75 is engaged automatically to limit free spooling of take up reel 81 when an operational parameter, such as hydraulic pressure, is exceeded. For example, if hydraulic pressure is reduced due a ruptured hose, the primary brake engages automatically. A secondary brake mounted to main hub 89 can be manually engaged with controllers to up or down shift the planetary gears for controlled spooling.

For extra safety, the boom apparatus can be deployed to stabilize take up reel 81 and frame 17 during operations.

In addition to providing mechanisms for improved alignment and safety, the present invention is sufficiently safe and automated that poly pipe can be pulled by the rig with no more than 2 human operators, providing a much more economical solution to pump pulling than is presently available.

An invention has been provided with several advantages. The submersible pump puller of the invention is simpler in design and less costly to produce than the prior art pump setting rigs and vertical towers. It is not necessary to have a crane present at the well site for the servicing operation. The apparatus of the invention is ideally suited for servicing water wells, but can also be used for other related tasks, such as pumping water off the top portion of a gas or oil well. The three separate degrees of movement of the components of the apparatus provide extremely accurate centering of the take up reel over the well bore being serviced. The apparatus is portable and can easily be transported over a roadway to another well site with only a short take down time being involved.

While the invention has been shown in only one of its forms, it is not thus limited but is susceptible to various changes and modifications without departing from the spirit thereof.

What is claimed is:

1. A method for pulling a pump in a well having a well casing, the pump being connected to a length of irrigation poly having a center line, with a poly reel rig, the method comprising:

providing a transportable poly reel rig having a front, a top and a bottom, a reel spool pivotally mounted to the reel rig by one or more pivotable cantilever arms to selectively pivot the one or more cantilever arms to raise or lower the reel spool to a desired position, a primary brake in automatic hydraulic braking communication with the reel spool and comprising a fluid pressure shut off valve, a secondary brake mounted on the reel spool and comprising an hydraulically controlled planetary gear drive, a top alignment reel and a bottom alignment reel, one or more controllers to automate alignment of the top alignment reel and the bottom alignment reel with the well bore, a wire roller operating in concert with the reel spool;

delivering the transportable poly reel rig to the well;

aligning by automation, with the one or more controllers, the reel spool with the top alignment reel and bottom alignment reel over the center of the well bore;

connecting a first end of a buried length of poly, wherein the poly is connected at a second end to the pump in the well, to the reel spool with the reel spool one or more cantilever arms in a horizontal orientation;

spooling the poly onto the poly reel;

transporting the transportable poly reel rig in concert with spooling the poly, such that rig approaches the well as the poly is spooled;

when the poly reel rig reaches the well, pivoting the one or more cantilever arms to lift the reel spool vertically; and pulling the pump from the well.

2. The method of claim 1, further comprising actuating the secondary brake as necessary to limit free spooling.

3. The method of claim 1, wherein a wire is attached to the poly and further comprising spooling the wire onto the wire reel while the poly is spooled onto the poly reel.

4. The method of claim 1, further comprising a boom assembly with two ends, at least one of which ends is connected to the transportable poly reel rig, the boom assembly having an arm selectively deployable horizontally so as to be suspendable over the bottom of the transportable poly reel rig; the method further comprising, after delivering the transportable poly reel rig to the well, deploying the boom assembly arm.

5. A method for laying irrigation poly with a poly reel rig to insert a pump into a well, the method comprising:

providing a transportable poly reel rig having a front, a top and a bottom, a reel spool pivotally mounted to the reel rig by one or more pivotable cantilever arms to selectively pivot the one or more cantilever arms to raise or lower the reel spool to a desired position, a primary brake in automatic hydraulic braking communication with the reel spool and comprising a fluid pressure shut off valve, a secondary brake mounted on the reel spool and comprising an hydraulically controlled planetary gear drive, a top alignment reel and a bottom alignment reel, one or more controllers to automate alignment of the top alignment reel and the bottom alignment reel with a bore of the well, a wire roller operating in concert with the reel spool, and two or more hydraulic stabilizers mounted to the reel rig;

providing a length of poly with a free end, on the reel spool;

providing a length of wire, wherein the length of wire has a free end, on the wire roller;

laying the poly by unspooling from the reel spool;

unspooling wire from the wire roller;

attaching unspooled wire periodically to the unspooled poly;

attaching a pump to the free end of the poly and to the free and of the wire;

pivoting the one or more cantilever arms to elevate the reel spool over the well;

aligning, with the one or more controllers, the reel spool and the top alignment reel and the bottom alignment reel with the well; and inserting the pump into the well.

6. The method of claim 5, further comprising actuating the secondary brake as necessary to limit free spooling.

7. The method of claim 5, further comprising a boom assembly with two ends, at least one of which ends is connected to the transportable poly reel rig, the boom assembly having an arm selectively deployable horizontally so as to be suspendable over the bottom of the transportable poly reel rig; the method further comprising, after delivering the transportable poly reel rig to the well, deploying the boom assembly arm.

8. An apparatus for pulling irrigation poly, the apparatus comprising:

a transportable poly reel rig having a front, a top and a bottom;

one or more pivotable cantilever arms attached to the transportable poly reel rig;

a reel spool pivotally mounted to the one or more cantilever arms;

a primary brake in automatic hydraulic braking communication with the reel spool and comprising a fluid pressure shut off valve;

a secondary brake mounted on the reel spool and comprising an hydraulically controlled planetary gear drive;

a top alignment reel positioned under the reel spool;

and a bottom alignment reel positioned under the top alignment reel;

one or more controllers to align the top alignment reel and the bottom alignment reel with a well bore;

a wire roller operating in concert with the reel spool; and two or more hydraulic stabilizers mounted to the reel rig.

9. The apparatus of claim 8, further comprising a boom assembly with two ends, at least one of which ends is connected to the transportable poly reel rig, the boom assembly having an arm selectively deployable horizontally so as to be suspendable over the bottom of the transportable poly reel rig.

* * * * *